US006738990B1

(12) United States Patent
Jackson

(10) Patent No.: US 6,738,990 B1
(45) Date of Patent: May 25, 2004

(54) TOILET SEAT LIFTING DEVICE

(76) Inventor: Michael Jackson, 51 Webbs La. #K3, Dover, DE (US) 19904

( * ) Notice: Subject to any disclaimer, the term of this patent is extended or adjusted under 35 U.S.C. 154(b) by 0 days.

(21) Appl. No.: 10/237,326

(22) Filed: Sep. 9, 2002

(51) Int. Cl.[7] ..... A47K 13/00
(52) U.S. Cl. ..... 4/246.1
(58) Field of Search ..... 4/246.1, 246.3, 4/246.4, 246.5

(56) References Cited

U.S. PATENT DOCUMENTS 2,117,663 A 5/1938 Hill
2,155,548 A 4/1939 Hompesch
5,311,619 A 5/1994 Ward ..... 4/246.1
6,158,059 A * 12/2000 Zhang ..... 4/246.2
6,308,347 B1 * 10/2001 King ..... 4/246.1
6,393,623 B1 * 5/2002 Strickland, Jr. ..... 4/246.3

* cited by examiner

*Primary Examiner*—Gregory Huson
*Assistant Examiner*—Huyen Le
(74) *Attorney, Agent, or Firm*—Goldstein Law Offices, P.C.

(57) ABSTRACT

A toilet seat lifting device for attachment to a toilet for allowing a user to raise and lower a toilet seat without having to manually touch the seat. The toilet seat lifting device has a frame situated alongside the side of the toilet bowl base. The toilet seat lifting device also has a pedal, a lift arm, and a pulley assembly having a cord connecting the pedal and the lift arm. The lift arm has a forward end, a rearward end, and a middle portion, the forward end secured to the underside of the toilet seat. The cord is attached to the lift arm rear portion. Pressing the pedal downward causing the pulley assembly to pivot the rear portion of the lift arm downward, thereby raising the toilet seat.

8 Claims, 3 Drawing Sheets

TOILET SEAT LIFTING DEVICE

BACKGROUND OF THE INVENTION

The invention relates to a toilet seat lifting device. In particular, the invention is a device that allows a user to lift and lower the toilet seat without having to manually touch the seat.

It is necessary for men to raise the toilet seat when urinating. However, most men forget to lower the seat again, thus leaving the task for the female who follows. Thus, there exists a need for a device which would allow a person to lift or lower the seat without actually touching the seat itself. Such a device would maintain the seat in the desired position until it is clear to lower the seat.

In addition, considering germs that are realistically present on the toilet seat, many people do not wish to touch the toilet seat. Accordingly, many people neglect to raise and/or lower the seat when appropriate for this reason alone.

Various devices have been proposed which seek to allow the toilet seat to be raised and lowered automatically and/or without touching the seat.

U.S. Pat. No. 2,117,663 to Hill discloses a "closet seat cover operator" which employs an overhead harness and a counterweight to facilitate opening and closing the lid. However, this device is cumbersome, unsightly, and would not be appropriate for modern restrooms.

U.S. Pat. No. 5,311,619 to Ward discloses a device in which a motor is mounted over the toilet to open and close the seat.

U.S. Pat. Nos. 2,155,548 and 2,115,548 to Hompesch both disclose pedal operated toilet seats. However, both devices employ levers which create a complicated apparatus, and which provide only minimum flexibility in where to locate the pedal.

While these units may be suitable for the particular. purpose employed, or for general use, they would not be as suitable for the purposes of the present invention as disclosed hereafter.

SUMMARY OF THE INVENTION

In view of the foregoing disadvantages inherent in the prior art, the present invention provides an improved toilet seat lifting device. As such, the general purpose of the present invention, which will be described subsequently in greater detail, is to provide a new and improved toilet seat lifting device which has all the advantages of the prior art and none of the disadvantages.

To attain this, the present invention essentially comprises a toilet seat lifting device for attachment to a toilet for allowing a user to raise and lower a toilet seat without having to manually touch the seat. The toilet seat lifting device has a frame situated alongside the toilet bowl base, a pedal, an lift arm, and a pulley assembly connecting the pedal and the lift arm. The lift arm has a forward end, a rearward end, and a middle portion. The forward end is secured to the underside of the toilet seat. The lift arm is hingeably attached to the frame at its middle potion and is attached to the pulley assembly at its rearward end. Pressing the pedal downward causing the pulley assembly to pivot the rear end of the lift arm downward, thereby raising the toilet seat.

It is an object of the invention to produce a toilet seat lifting device that allows a user to change the positioning of the toilet seat without having to touch the seat with his or her hands. Accordingly, the device comprises a pulley assembly in communication with a pedal and a lift arm, said lift arm connected to the toilet seat. Thus, depression of the pedal causes the toilet seat to lift upward. The pedal may be positioned in any convenient location around the base of the toilet.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
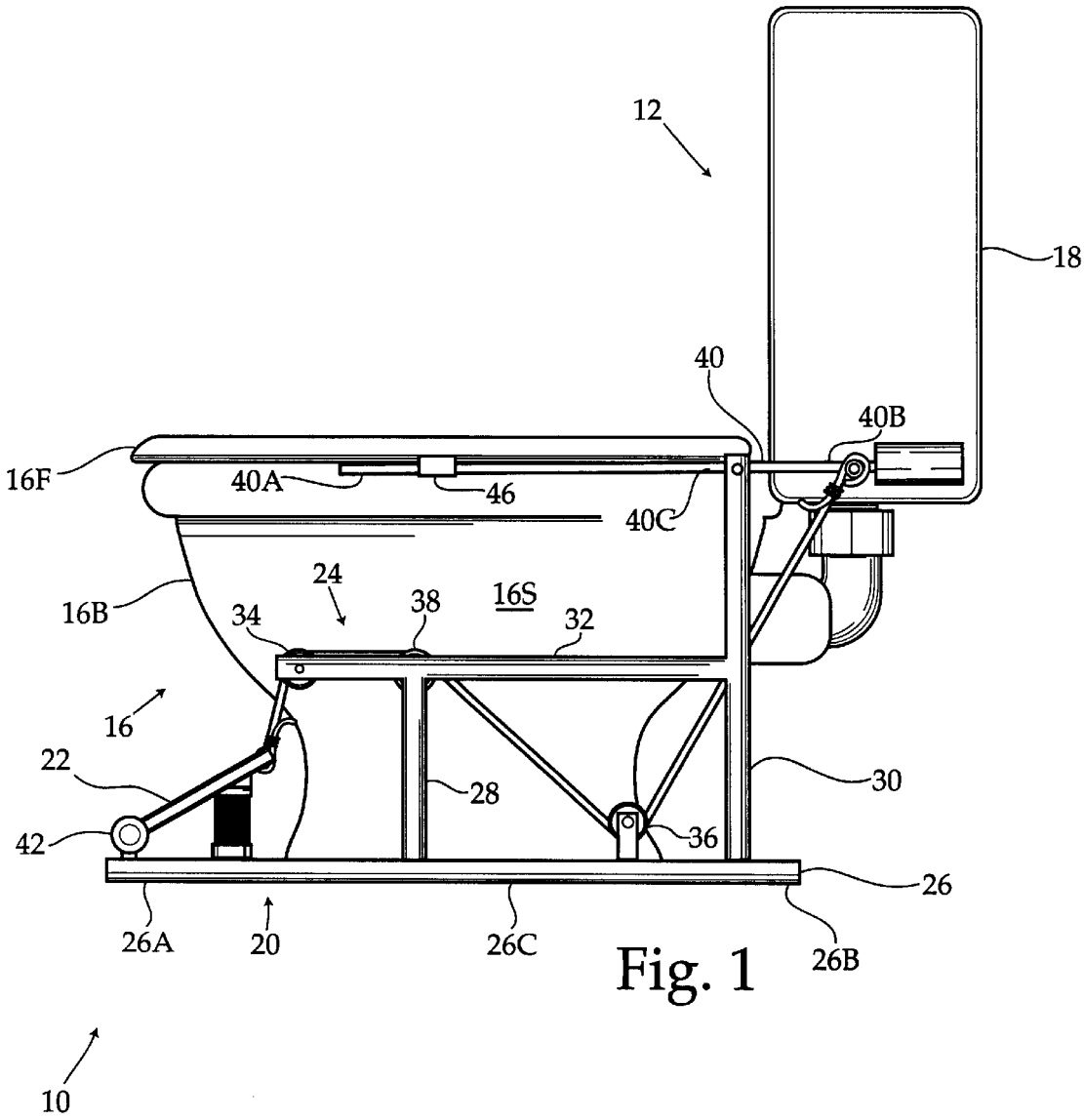
FIG. 1 is a side elevational view of the toilet seat lifting device mounted alongside a toilet, illustrating the toilet seat in the lowered position, with the toilet seat lid, typically present immediately above the seat removed for clarity.
Figure 2:
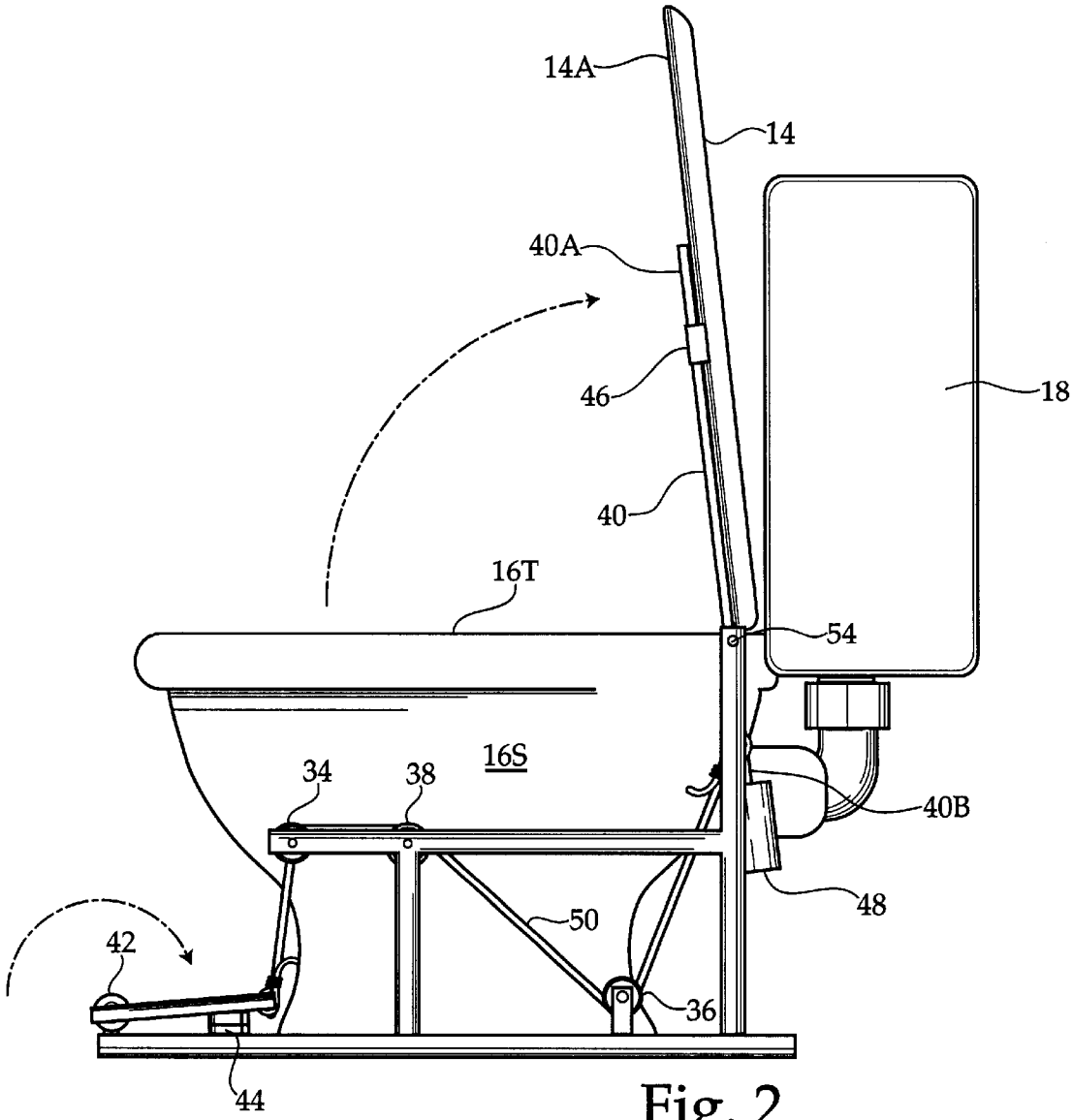
FIG. 2 is a side elevational view of the toilet seat lifting device mounted about a toilet, illustrating the toilet seat in the raised position.

10 toilet seat lifting device
12 toilet
14 toilet seat
14A toilet seat underside
15 toilet seat hinge
16 toilet bowl
16B toilet bowl base
16T toilet bowl top opening
16S toilet bowl side
16F toilet bowl front
18 toilet tank
20 toilet seat lifting device frame
22 pedal
22A pedal free end
22B pedal connected end
22C pedal stepping platform
24 pulley assembly
26 frame base
26A base forward end
26B base rearward end
26C base middle portion
28 frame forward vertical support
30 frame rearward vertical support
32 frame horizontal support
34 pedal pulley
36 lift arm pulley
38 horizontal translation pulley
40 lift arm
40A lift arm forward end
40B lift arm rearward end
40C lift arm middle portion
42 pedal pivot
44 spring
46 fastening device
48 counter weight
50 cord

52 lift arm point
54 lift arm pivot point

DETAILED DESCRIPTION OF THE PREFERRED EMBODIMENTS

FIG. 1 illustrates a toilet seat lifting device 10 for attachment to a toilet 12 for allowing a user to raise and lower a toilet seat 14 without having to manually touch the seat 14, said toilet seat 14 having an underside 14A. The toilet 12 comprises a tank 18 and a bowl 16, the bowl 16 having a base 16B, a top opening 16T, and a side surface 16S extending around the base 16B. The toilet seat 14 is hingeably attached to the bowl 16 with a toilet seat hinge 15, proximate to the tank 18, and selectively covers a portion of the outer perimeter of the bowl top opening 16T when said seat 14 is in the lowered position. The toilet seat lifting device 10 essentially comprises a frame 20 situated alongside the side surface 16S of the toilet bowl base 16B, a pedal 22, a lift arm 40, and a pulley assembly 24 which connects the pedal 22 and the lift arm 40. The lift arm is attached to the frame lift arm pivot point 54. The pulley assembly 24 enables the user to raise and lower the seat 14 by stepping on the pedal 22.

Figure 3:
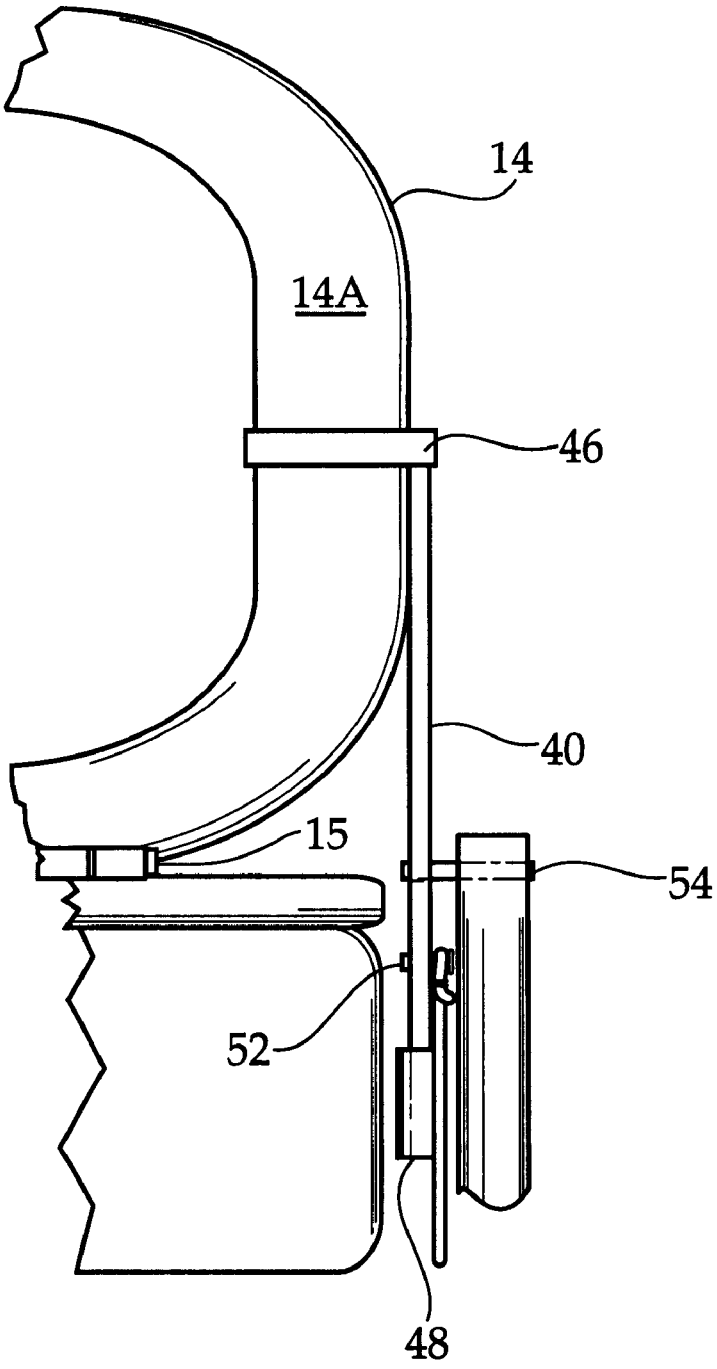
FIG. 3 is an enlarged view of the toilet seat in the raised position, illustrating the attachment of the lift arm to the seat underside and preferred positioning of the lift arm with respect to the toilet seat hinge.

The frame 20 comprises a horizontal base 26 and a plurality of supports that are mounted alongside the toilet bowl base 16B on the side surface 16S thereof. The supports comprise a forward vertical support 28, a rearward vertical support 30 and a horizontal support 32 bridged across said vertical supports 28, 30. The base 26 has a forward end 26A, a rearward end 26B, and a middle portion 26C therebetween, wherein the forward end 26A is positioned in front of the bowl base 16B and the rearward end 26B is positioned under the toilet tank 18. The forward vertical support 28 extends upward from the base middle portion 26C to the middle of the bowl base side surface 16S. The rearward vertical support 30 extends upward from the base rearward end 26B to substantially the height of the toilet top opening 16T. Referring momentarily to FIG. 3, the frame is preferably positioned so that the lift arm pivot point 54 is positioned coaxially with the toilet seat hinge 15 to provide the smoothest movement of the seat. The horizontal support 32 extends parallel to the base 26, beginning at the middle of the rearward vertical support 30 and extending to a point past the forward vertical support 28.

The pedal 22 has a free end 22A, a connected end 22B, and a stepping platform 22C between the ends 22A, 22B. The pedal connected end 22B is attached to a pedal pivot 42 at the forward end 26A of the base 26, said pivot 42 allowing the pedal free end 22A to decline downward towards the base 26. A spring 44 extends longitudinally from the pedal free end 22A to the base 26, wherein upon declination of the pedal 22, the spring 44 is compressed. Once pressure is removed from the pedal stepping platform 22C, the spring 44 expands, thereby causing the pedal to move upward away from the base 26. Accordingly, the spring 44 biases the pedal 22 upward wherein the toilet seat is in the lowered position.

The lift arm 40 is in communication with the pedal 22 through the pulley assembly 24, as will be described in greater detail hereinafter. The lift arm 40 has a forward end 40A, a rearward end 40B, and a middle portion 40C positioned therebetween, wherein the forward end 40A is attached to the toilet seat 14. The lift arm forward end 40A is secured to the toilet seat underside 14A by means of a fastening device 46. A number of different fastening devices 46 may be employed. By way of example, a U-clip may be extended around the toilet seat underside. Such a clip may be constructed so that it is capable of sliding along the seat when said seat is raised or lowered. The lift arm middle portion 40C is secured to the frame rearward vertical support 30 at the lift arm pivot point 54, said portion 40C able to pivot upward and downward about the support 30. A counterweight 48 may be secured to the lift arm rearward end 40B in order to balance to the weight of the toilet seat and smooth the lifting and lowering of the toilet seat 14.

The pulley assembly 20 comprises a plurality of pulleys that serve to translate the downward tension caused by pressing on the pedal 22 rearwardly to the lift arm 40, thereby pivoting the lift arm 40 downward in order to raise the toilet seat 14 upward. Thus, the pulley assembly 20 allows the pedal 22 to be conveniently located at the bowl front 16F. The pulley assembly 24 is comprised of a pedal pulley 34, a lift arm pulley 36, a horizontal translation pulley 38 positioned therebetween, and a cord 50 attached between the pedal free end 22A and the lift arm 40, and running between the pulleys 34, 36, 38, which deflect the cord to pull upon the lift arm at a desired angle to effectively lift the toilet seat. The pedal pulley 34 is secured to the free end of the horizontal support 32, the horizontal translation pulley 38 is attached to the intersection point between the horizontal support 32 and the forward vertical support 28, and the lift arm pulley 36 is attached to the base 26, between the vertical supports 28, 30. The cord 50 is secured around the lift arm 40 at a point that creates an effective angle for tilting the lift arm rearward end 40B downward.

In use, the user steps on the pedal stepping platform 22C in order to raise the toilet seat 14 from the toilet bowl top opening 16T. Upon pressing on the pedal 22, the spring 44 compresses and the cord 50 is pulled downward towards the base 26. This motion creates a tension which pulls the cord 50 downward. The pulley assembly translates the tension rearward towards the rearward vertical support 30 and the lift arm point 52. The pulley assembly 24 causes the cord 50 to be pulled downward, thus also pulling the lift arm rearward end 40B downward and raising the toilet seat 14.

In conclusion, herein is presented a toilet seat lifting device that allows a user to raise or lower the toilet seat without having to manually touch said seat. The invention is illustrated by example in the drawing figures, and throughout the written description. It should be understood that numerous variations are possible, while adhering to the inventive concept. Such variations are contemplated as being a part of the present invention.

What is claimed is:

1. A toilet seat lifting device for attachment to a toilet, the toilet having a tank and a bowl, the bowl having a base, and a side surface extending around the base, the toilet seat having an underside and being hingeably attached to the bowl, comprising:

a frame, the frame mountable alongside the toilet bowl base side surface, said frame having a base and a plurality of supports;

a pedal, the pedal having a free end, a connected end, and a stepping platform between the ends, wherein the connected end is attached to a pivot on the base, said pivot allowing the pedal free end to decline downward towards the base;

a lift arm, the lift arm being in communication with the pedal, said lift arm having a forward end, a rearward end, and a middle portion positioned therebetween, wherein the lift arm is attached to the toilet seat underside at the forward end, wherein the lift arm is secured to the frame at the middle portion of the lift arm defining a lift arm pivot point, such that when the rearward end pivots downward the seat is raised; and a pulley assembly, the assembly comprising a plurality of pulleys secured to the frame supports and base, and a cord extending between the pedal and the lift arm, said cord connecting the pedal free end to the lift arm rear portion, wherein declination of the pedal causes the cord to be pulled downward, the tension of the cord is translated by the pulley assembly to pivot the rearward end of the lift arm downward to raise the toilet seat.

2. The toilet seat lifting device as recited in claim 1, wherein the frame supports comprise a forward vertical support, a rearward vertical support, and a horizontal support bridged across the vertical supports, and wherein the frame base has a forward end, a rearward end, and a middle portion therebetween, said forward end aligned with the front of the toilet bowl base and said rearward end aligned with the toilet tank.

3. The toilet seat lifting device as recited in claim 2, wherein the frame forward vertical support extends upward from the base middle portion, and wherein the frame rearward vertical support extends upward from the base rearward end to a point past the lowered toilet seat, and wherein the horizontal support extends parallel to the base beginning at the middle of the rearward vertical support and extending to a point past the forward vertical support.

4. The toilet seat lifting device as recited in claim 3, wherein the pulley assembly further comprises a pedal pulley and a lift arm pulley, wherein the pedal pulley is secured to the free end of the frame horizontal support and the lift arm pulley is secured to the base, between the vertical supports.

5. The toilet seat lifting device as recited in claim 4, wherein the pulley assembly further comprises a horizontal translation pulley positioned between the pedal pulley and the lift arm pulley, said horizontal translation pulley secured to the frame horizontal support.

6. The toilet seat lifting device as recited in claim 5, wherein the lift arm middle portion is secured to the frame rearward vertical support.

7. The toilet seat lifting device as recited in claim 6, further comprising a spring, the spring extending longitudinally from the pedal free end to the base forward end, wherein upon declination of the pedal, the spring is compressed, and upon removal of pressure from the pedal stepping platform, the spring expands, thereby causing the pedal to move upward away from the base.

8. The toilet seat lifting device as recited in claim 7, wherein the lift arm further comprises a counterweight secured to the lift arm rearward end in order to balance the toilet seat to smooth the raising and lowering of the toilet seat.

* * * * *